US006418709B1

(12) United States Patent
Narcus et al.

(10) Patent No.: US 6,418,709 B1
(45) Date of Patent: Jul. 16, 2002

(54) GAS TURBINE ENGINE LINER

(75) Inventors: Andrew Narcus, Loxahatchee, FL (US); Keith Brewer, Federal Way, WA (US); Thomas F. Pechette, Palm Beach Gardens, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/570,883

(22) Filed: May 15, 2000

(51) Int. Cl.[7] ..... F02K 1/38; F02K 3/08
(52) U.S. Cl. ..... 60/261; 60/266; 239/127.3
(58) Field of Search ..... 60/226.3, 266, 60/261, 265, 39.23, 752, 39.32; 239/127.3

(56) References Cited

U.S. PATENT DOCUMENTS

| | | | | |
|---|---|---|---|---|
| 2,837,893 A | | 6/1958 | Schirmer et al. | 60/39.23 |
| 3,729,139 A | * | 4/1973 | Roberts | 239/127.3 |
| 4,071,194 A | * | 1/1978 | Eckert et al. | 239/127.3 |
| 4,098,076 A | * | 7/1978 | Young et al. | 60/266 |
| 4,109,864 A | * | 8/1978 | Clayton | 239/127.3 |
| 5,209,059 A | * | 5/1993 | Ward | 60/266 |
| 5,211,675 A | | 5/1993 | Bardey et al. | 60/39.2 |
| 5,307,624 A | * | 5/1994 | Even-Nur et al. | 60/226.3 |
| 5,317,863 A | * | 6/1994 | Ciccia et al. | 60/39.23 |
| 5,557,920 A | * | 9/1996 | Kain | 60/39.23 |
| 5,687,562 A | | 11/1997 | Stewart et al. | 60/226.3 |
| 5,690,279 A | * | 11/1997 | Kramer et al. | 239/127.3 |
| 5,694,767 A | * | 12/1997 | Vdoviak et al. | 60/226.3 |
| 5,749,218 A | * | 5/1998 | Cromer et al. | 60/39.31 |

OTHER PUBLICATIONS

Patent Abstract, Japan, "Low Nox Gas Turbine Combustor" Publication No. 59086823, May 19, 1984.

* cited by examiner

*Primary Examiner*—Ted Kim
(74) *Attorney, Agent, or Firm*—Kenneth C. Baran

(57) ABSTRACT

A liner for a gas turbine engine is provided that includes a first liner section and a second liner section. The first liner section includes a first flange having a first contact surface. The second liner section includes a second flange having a second contact surface and a plurality of apertures. The first and second flanges axially overlap one another, and in a circumferential liner the second flange is disposed radially outside of the first flange. A channel is formed by the two liner sections that is open to the core gas path. In a first position, the first flange axially overlaps the second flange by a first distance and the apertures are misaligned with the first flange and disposed within the channel. Cooling air entering apertures within the second flange subsequently passes into the channel. In a second position, the first flange axially overlaps the second flange by a second distance. The second distance is greater than the first distance and in the second position the apertures in the second flange are substantially aligned with the first flange. Cooling air entering the second flanges apertures subsequently impinges on the first flange.

14 Claims, 2 Drawing Sheets

GAS TURBINE ENGINE LINER

The Government has rights in this application pursuant to Contract No. F33657-91-C-0007 awarded by the Department of the Air Force.

BACKGROUND OF THE INVENTION

1. Technical Field

This invention applies to gas turbine engines in general, and to core gas path liners within gas turbine engines in particular.

2. Background Information

Thrust is produced within a gas turbine engine by compressing air within a fan and a compressor, adding fuel to the air within a combustor, igniting the mixture, and finally passing the combustion products (referred to as core gas) through a nozzle. A turbine positioned between the combustor and the nozzle extracts some of the energy added to the air to power the fan and compressor stages. In an augmented gas turbine engine, additional thrust is produced by adding fuel to the core gas exiting the turbine and igniting the mixture.

By itself, the high temperature core gas exiting the turbine creates a severe thermal environment in the core gas path downstream of the turbine. When fuel is combusted in the augmentor, the temperature of the core gas within the augmentor and the nozzle increases significantly. The panels that surround the core gas path are subject to the high temperature gas, and as a result experience significant thermal growth. The junctions between panels, particularly dissimilar panels, must be designed to accommodate significant thermal growth. The panels and the junctions between panels must also be coolable under normal operating conditions as well as under augmented operation.

What is needed, therefore, is an apparatus for containing core gas within the core gas path, one that accommodates thermal growth associated with normal operation and augmented operation, and one that is coolable under normal and augmented operation conditions.

DISCLOSURE OF THE INVENTION

It is, therefore, an object of the present invention to provide an apparatus for containing core gas within the core gas path of a gas turbine engine, one that accommodates thermal growth associated with normal operation and augmented operation of a gas turbine engine, and one that is coolable under normal and augmented operation conditions.

According to the present invention a liner for a gas turbine engine is provided that includes a first liner section and a second liner section. The first liner section includes a first flange having a first contact surface. The second liner section includes a second flange having a second contact surface and a plurality of apertures. The first and second flanges axially overlap one another, and in a circumferential liner the second flange is disposed radially outside of the first flange. A channel is formed by the two liner sections that are open to the core gas path. In a first position, the first flange is axially received a first distance inside the second flange and the apertures are misaligned with the first flange and disposed within the channel. Cooling air entering apertures within the second flange subsequently passes into the channel. In a second position, the first flange is axially received a second distance inside the second flange. The second distance is greater than the first distance and in the second position the apertures are aligned with the first flange. Cooling air entering the second flanges apertures subsequently impinges on the first flange.

The present invention provides a liner for a gas turbine engine that advantageously accommodates considerable thermal expansion, and at the same time provides cooling in the junction between liner sections. The liner sections of the present invention form a channel that allows the sections to axially move relative to one another. Apertures within the first and second flanges enable cooling air to pass through and thereby cool the flanges. In the first position, cooling air passing through the apertures within the second flange enters the channel formed between the two liner sections, thereby providing cooling to the second flange and a means for purging hot gas and unburned fuel from the channel. In the second position, cooling air passing through the apertures within the second flange impinges on the first flange, thereby providing cooling to the first flange.

These and other objects, features, and advantages of the present invention will become apparent in light of the detailed description of the best mode embodiment thereof, as illustrated in the accompanying drawings.

BEST MODE FOR CARRYING OUT THE INVENTION

Figure 1:
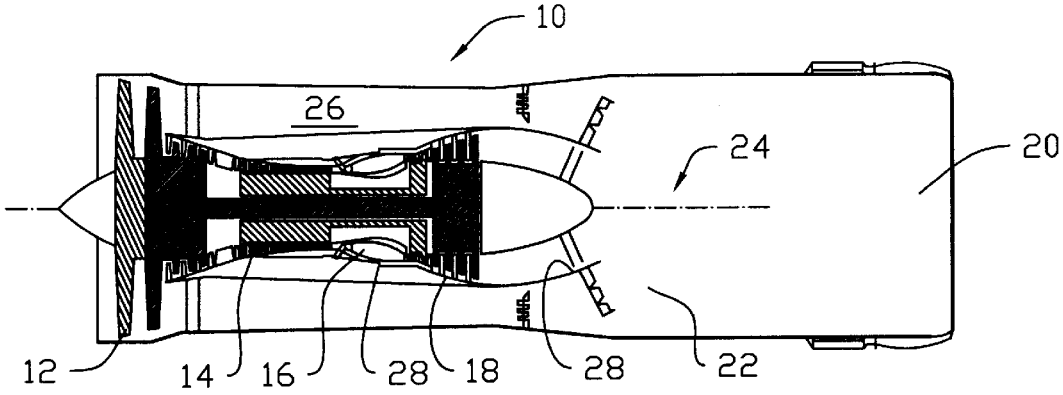
FIG. 1 is a diagrammatic illustration of a gas turbine engine.
Figure 2A:
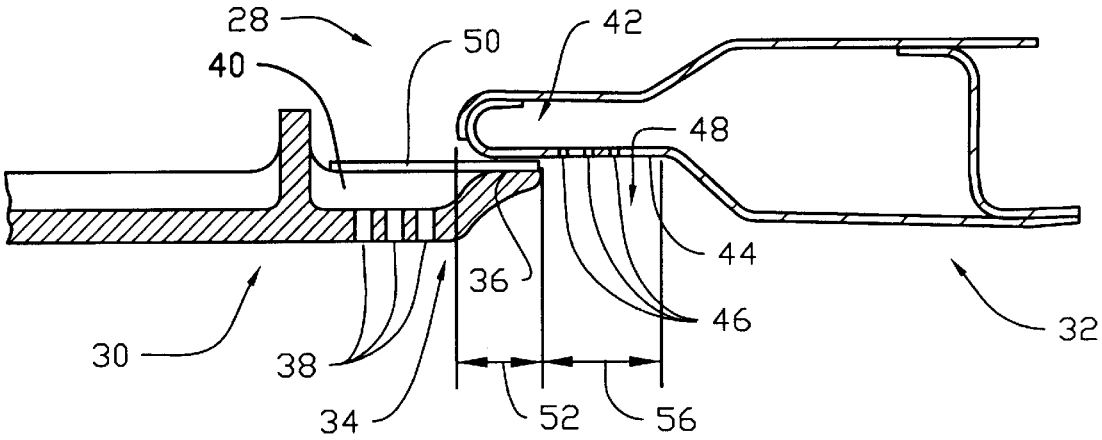
FIG. 2A is a diagrammatic view of a liner that includes a first section and a second section located relative to one another in a first, or "open position".
Figure 2B:
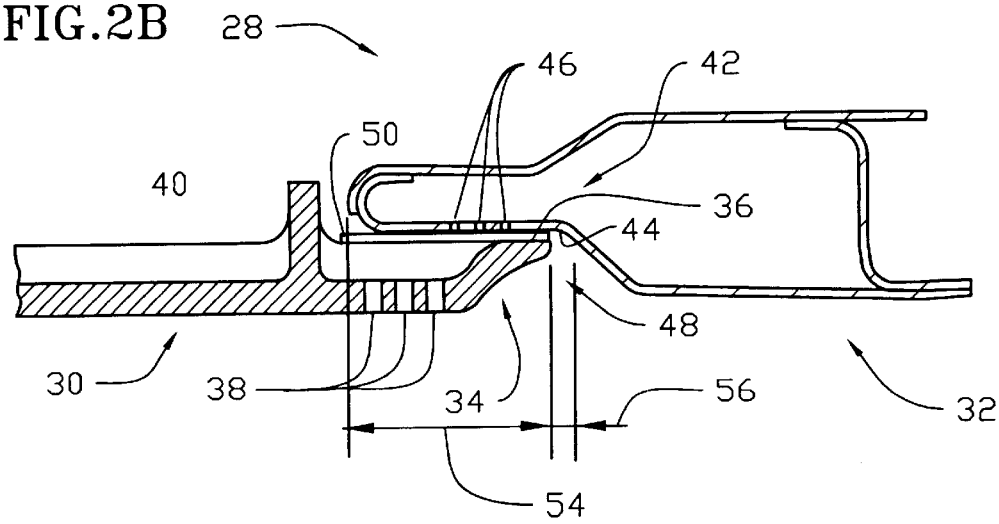
FIG. 2B is a diagrammatic view of a liner that includes a first section and a second section located relative to one another in a second, or "closed position".
Figure 3:
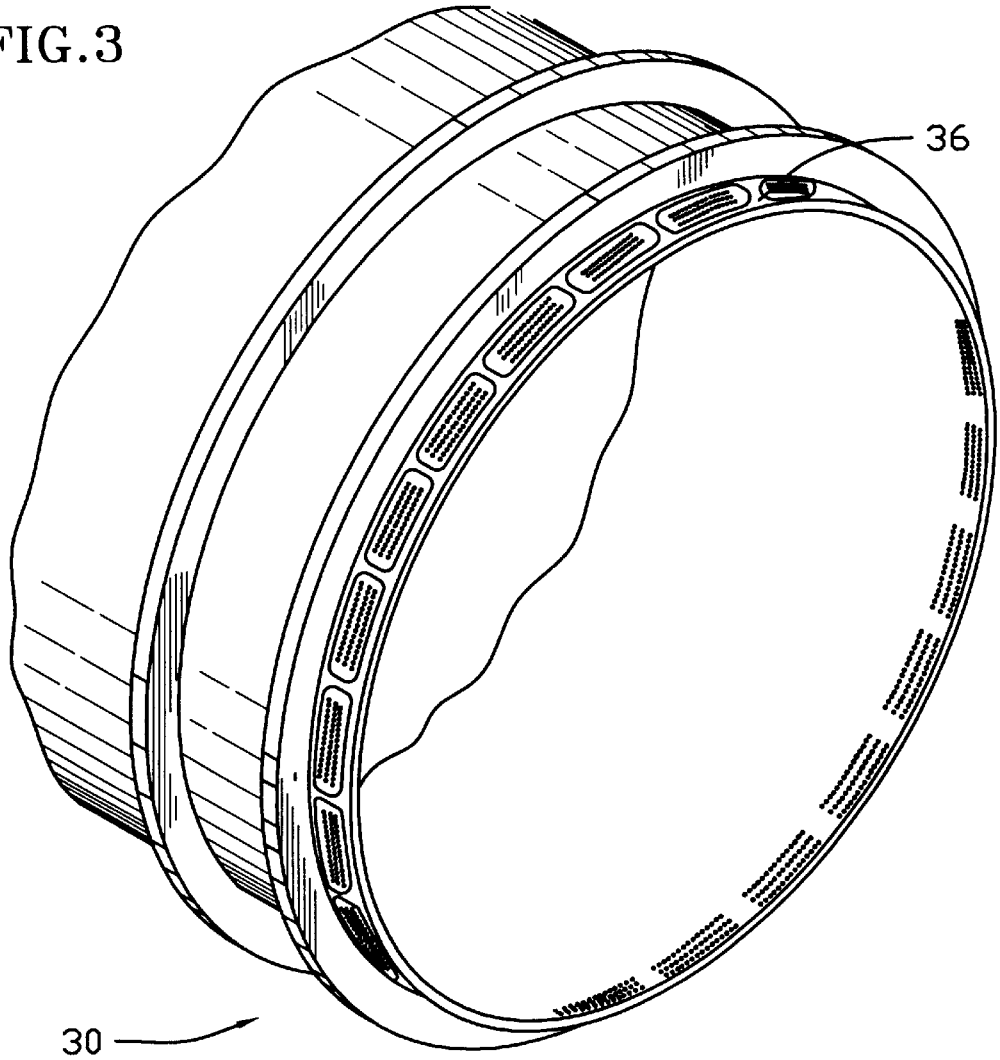
FIG. 3 is a diagrammatic view of a liner section.
Figure 4:
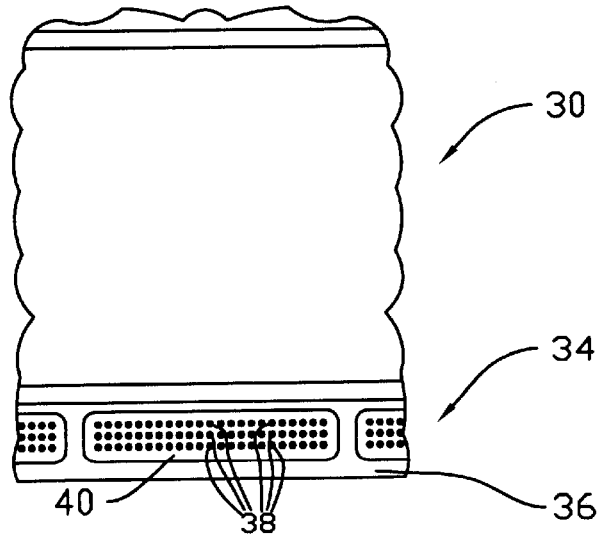
FIG. 4 is a top view of a portion of a liner section.

Referring to FIG.1, a gas turbine engine 10 may be described as having a fan 12, a compressor 14, a combustor 16, a turbine 18, and a nozzle 20. Some engines further include an augmentor 22 disposed between the turbine 18 and the nozzle 20. Core gas flow follows an axial path through the compressor 14, combustor 16, turbine 18, augmentor 22, and exits through the nozzle 20; i.e., a path substantially parallel to the axis 24 of the engine 10. Bypass air worked by the fan 12 passes through an annulus 26 extending along the periphery of the engine 10. Aft of the compressor 14, core gas flow is at a higher pressure than bypass air flow. Fuel added to the core gas and combusted within the combustor 16 and the augmentor 22 significantly increases the temperature of the core gas. Circumferential liners 28 in and aft of the combustor 16 guide the high temperature core gas.

Referring to FIGS. 2A, 2B, 3, and 4, a liner 28 in or adjacent the augmentor 22 (see FIG. 1) includes a first section 30 and a second section 32. The first section 30 has a circumferentially extending first flange 34 that includes a contact surface 36 and a plurality of apertures 38. In a preferred embodiment, the first flange 34 includes a plurality of pockets 40 (see also FIG. 4) disposed in the contact surface 36, distributed around the circumference of the first flange 34 (see FIG. 3). The second section 32 has a circumferentially extending second flange 42 that includes a contact surface 44 and a plurality of apertures 46. A channel 48 is formed by the two liner sections 30,32, open to the core gas path. In some embodiments, a wear member 50 (e.g., a bearing ring) is disposed between the contact surfaces 36,44 of the flanges 34,42, attached to one of the first flange 34 or second flange 42. Alternatively, a wear member 50 in the form of a coating can be bonded to one or both of the contact surfaces 36,44 to facilitate the interface between the two sections 30,32.

The first flange 34 and the second flange 42 axially overlap one another. In a circumferential liner (FIG. 3), the second flange 42 is radially outside the first flange 34. In a first position of the two liner sections 30,32, the first flange 34 axially overlaps the second flange 42 by a first distance 52. In the first position, the apertures 46 within the second flange 42 are misaligned with the first flange 34 and disposed within the channel 48. Cooling air entering second flange apertures 46 subsequently passes into the channel 48. In a second position, the first flange 34 is axially overlaps the second flange 42 by a second distance 54, and the apertures 46 within the second flange 42 are aligned with the first flange 34. Cooling air entering the second flange apertures 46 subsequently impinges on the first flange 34.

In the operation of a gas turbine engine utilizing the present invention, the liner 28 is exposed to hot core gas traveling through the engine. Upon exposure, the liner 28 will axially grow an amount due to thermal expansion, and that amount is related to the amount of thermal energy transferred to the liner 28 by the core gas. Operating conditions that produce higher than average temperatures will concomitantly produce higher than average thermal growth in the liner 28. A liner 28 within a gas turbine engine 10 will experience thermal conditions ranging from "cold" conditions where the engine is not under power, to conditions where the engine is being operating under maximum unaugmented power. Liners 28 in and aft of the augmentor 22 will experience an additional range of thermal conditions between unaugmented power and fully augmented power.

The present invention accommodates the range of thermal conditions and consequent thermal growth by allowing axial movement between the liner sections 30,32. The width 56 of the channel 48 formed by the liner sections 30,32 is inversely related to the temperature of the core gas; the channel 48 increases in width as the temperature of the core gas decreases, and decreases in width as the temperature of the core gas increases. The apertures 46 within the second flange 42 are positioned within the second flange 42 so as to be misaligned with the first flange 34 under certain predetermined operating conditions, to enable cooling air to enter the channel 48 through the apertures 46. The air passing through the apertures 46 in the second flange 42 and into the channel 48 cools the second flange 42, and purges core gas and any unspent fuel that may be present within the channel 48, thereby decreasing the potential for thermal degradation in the channel region and/or fuel combustion. At the same time, the first flange 34 is cooled by cooling air passing through the apertures 38 in the first flange 34. Under other predetermined operating conditions, the second flange 42 is positioned such that the apertures 46 within the second flange 42 are substantially aligned with the first flange 34. Cooling air passing through the second flange apertures 46 impinges on the first flange 34, thereby providing cooling to the first flange 34. In this position, the width 56 of the channel 48 is relatively insubstantial and requires significantly less purging. Consequently, it is advantageous to utilize the cooling air elsewhere that would have otherwise been directed into the channel 48.

Functionally, the present invention may also be utilized as a self-actuating thermally controlled liner valve that permits the passage of cooling air back into the core gas path. In an "open" position, the apertures 46 within the second flange 42 are disposed in the channel and therefore misaligned with the first flange 34. In a "closed" position, the apertures 46 within the second flange 42 are not aligned with the channel 48 thereby inhibiting cooling air flow into the channel 48. In some applications, it may be advantageous to alter the geometry of the apertures to suit the application at hand. For example, if there is advantage to minimizing the pressure drop across the liner valve, and/or increasing the flow area, the apertures described above can be replaced with larger area ports.

Although this invention has been shown and described with respect to the detailed embodiments thereof, it will be understood by those skilled in the art that various changes in form and detail thereof may be made without departing from the spirit and the scope of the invention.

What is claimed is:

1. An augmentor liner, comprising:

a first section having a first flange that includes a first contact surface; and a second section having a second flange that includes a second contact surface and a plurality of second apertures, and wherein said first flange and said second flange axially overlap one another; and a channel formed by said first section and said second section;

wherein in a first position said first flange axially overlaps said second flange a first distance and said apertures in said second flange are disposed within said channel, and in a second position said first flange overlaps said second flange a second distance, said second distance greater than said first distance, and said second apertures are aligned with said first flange.

2. The augmentor liner of claim 1, further comprising a wear member disposed between said first flange and second flanges.

3. The augmentor liner of claim 2, wherein said wear member is a coating bonded to one of said first contact surface or said second contact surface, and the other of said first contact surface or said second contact surface is in contact with said wear member.

4. The augmentor liner of claim 3, wherein said first flange includes a plurality of pockets disposed in said first contact surface, and said second contact surface is in contact with said wear member.

5. The augmentor liner of claim 2, wherein said first flange includes a plurality of pockets disposed in said first contact surface, and said second contact surface is in contact with said wear member.

6. The augmentor liner of claim 5, wherein said wear member is a ring attached to one of said first contact surface or said second contact surface.

7. The augmentor liner of claim 2, wherein said wear member is a ring attached to one of said first contact surface or said second contact surface, and the other of said first contact surface or said second contact surface is in contact with said wear member.

8. The augmentor liner of claim 1, wherein said first flange includes a plurality of pockets disposed in said first contact surface.

9. The augmentor liner of claim 1, wherein said first flange and said second flange are circumferentially extending and said first flange is disposed radially inside of said second flange.

10. The augmentor liner of claim 9, wherein said first flange includes a plurality of cooling apertures.

11. A self-actuating thermally controlled liner valve, comprising:

a first liner section having a circumferentially extending first flange, said first flange having a first contact surface; and a second liner section having a circumferentially extending second flange, said second flange having a second contact surface and a plurality of second apertures, and wherein said second flange is disposed radially outside of said first flange;

wherein under a first set of operating conditions said valve is in an open position, and in said open position said second apertures are misaligned with said first flange to permit the flow of air; and wherein under a second set of operating conditions said first liner section and said second liner section thermally grow toward one another, thereby placing said valve in a closed position wherein said second apertures are aligned with said first flange to redirect the flow of air.

12. The valve of claim 11, further comprising a wear member disposed between said first flange and second flanges.

13. The valve of claim 12, wherein said wear member is a coating bonded to one of said first contact surface or said second contact surface.

14. The valve of claim 12, wherein said wear member is a ring attached to one of said first contact surface or said second contact surface.

* * * * *